US007591400B2

(12) United States Patent
Penciu et al.

(10) Patent No.: US 7,591,400 B2
(45) Date of Patent: Sep. 22, 2009

(54) CARTRIDGE FOR DISPENSER OF PARTICULAR FLUID SUBSTANCES

(76) Inventors: Cristian Penciu, 4823 Myerwood La., Dallas, TX (US) 75244; Victor Sebastian Penciu, P.O. Box 670082, Dallas, TX (US) 75367

( * ) Notice: Subject to any disclaimer, the term of this patent is extended or adjusted under 35 U.S.C. 154(b) by 274 days.

(21) Appl. No.: 11/363,957

(22) Filed: Feb. 28, 2006

(65) Prior Publication Data

US 2006/0192818 A1 Aug. 31, 2006

Related U.S. Application Data

(60) Provisional application No. 60/656,417, filed on Feb. 28, 2005.

(51) Int. Cl.
*B65D 88/54* (2006.01)

(52) U.S. Cl. ..... 222/325; 222/94

(58) Field of Classification Search ..... 222/325–327, 222/490, 94, 129, 130, 132, 135, 383.3, 387, 222/492, 493, 499, 522; 347/86, 84; 220/800, 220/801

See application file for complete search history.

(56) References Cited

U.S. PATENT DOCUMENTS

| | | | | |
|---|---|---|---|---|
| 5,633,667 | A * | 5/1997 | Miyazawa | 347/86 |
| 6,089,540 | A | 7/2000 | Heinrichs et al. | |
| 6,220,570 | B1 | 4/2001 | Heinrichs et al. | |
| 6,332,481 | B1 * | 12/2001 | Shinada et al. | 141/18 |
| 6,422,691 | B2 * | 7/2002 | Kobayashi et al. | 347/86 |
| 6,796,460 | B2 | 9/2004 | Ichikawa et al. | |
| 6,935,730 | B2 * | 8/2005 | Qingguo et al. | 347/86 |
| 6,976,608 | B2 | 12/2005 | Ichikawa et al. | |
| 6,984,030 | B2 | 1/2006 | Shinada et al. | |

* cited by examiner

*Primary Examiner*—Lien T Ngo

(57) ABSTRACT

A cartridge capable of long term storing and repeated dispensing of a variety of fluid substances that change their properties when exposed to air. These fluid substances can have properties that make them difficult to store and dispense such as high viscosity, sticky, fast drying, and oxidizing in contact with air.

6 Claims, 3 Drawing Sheets

CARTRIDGE FOR DISPENSER OF PARTICULAR FLUID SUBSTANCES

This patent application claims the benefit under 35 U.S.C. 119 (e) of the U.S. Provisional Patent Application No. 60/656,417, filed on Feb. 28, 2005.

FIELD OF THE INVENTION

The present invention is a novel cartridge that is used in a dispenser for particular fluid substances. Examples of particular fluid substances comprise: fast drying paints, substances/fluids that can not be exposed to air before dispensing, substances/fluids with high viscosity, and sticky substances. In particular the cartridge can be used, but not limited to, as a reservoir for storing to be dispensed cosmetic substances such as nail polish, hair dyes, eye shadow, lip gloss, lipstick, lotions, moisturizers, creams, and sunscreens.

BACKGROUND ART

There are many designs of cartridges and pre-filled containers for dispensing various substances. A very familiar cartridge is the type used in inkjet printers. These cartridges also include the dispensing mechanisms such as bubble jet or piezo-electric. The content (ink) of the cartridge is exposed to air in order to equalize the pressure as the volume of the ink in the cartridge decreases with usage. If left unused for some time, the small dispensing orifices clog and require cleaning. These cartridges can only dispense fluids/inks with low viscosities. Therefore, controlling the fluid flow in the cartridge becomes very important and methods to do that have been proposed as seen in U.S. Pat. No. 6,984,030. Due to their complexity, these cartridges are expensive. Another type of cartridge that is commonly used is exemplified by the glue or silicone refill tubes employed extensively in constructions. These are very simple and cheap designs, basically cylinder tubes filed with the fluid substance to be dispensed that are sealed at both ends. Mechanically applied pressure (squeeze out) is used for removing the content of the cartridge. After the seal is broken, these cartridges can only be used for a short period of time due to a lack of re-sealing ability. There are many instances in the prior art that describe these type of cartridges such as U.S. Pat. Nos. 6,796,460 and 6,976,608. Methods to provide better leakage sealing are described in prior art in U.S. Pat. Nos. 6,089,540 and 6,226,570. Yet another kind of cartridge is the pressurized container type. These cartridges are filled with the substance to be dispensed and a pressurized gas. A valve type opening allows for removing the substance out of the container with the assistance of the pressurized gas. These cartridges pose a problem when the substance to be dispensed is very sticky and hardens in contact with air, therefore clogging the dispensing valve opening when some time passes between uses.

SUMMARY OF THE INVENTION

The present invention is a cartridge capable of storing a variety of particular fluid substances. These substances can have properties that make them difficult to store and dispense such as, but not limited to, high viscosity, sticky, quick drying, and oxidizing in contact with air. The novel cartridge solves many of the shortcomings found in other cartridge designs including clogging of the dispensing orifice and the ability to be stored for long periods of time without affecting the properties of the substance contained in the cartridge and without needing any cleaning or other maintenance before reuse of the cartridge. The novel cartridge contains multiple chambers, one which is filled-up with the particular fluid substance to be dispensed and at least a second chamber filled-up with a suitable solvent for the particular substance in the first chamber. A normally closed valve separates any two adjacent chambers and an additional normally closed valve separates the last solvent filled chamber from the outside of the cartridge.

DETAILED DESCRIPTION OF THE INVENTION

The present invention provides a novel cartridge capable of storing a variety of particular fluid substances that can be dispensed out of it. These substances can have properties that make them difficult to store and dispense such as, but not limited to, high viscosity up to 3,000,000 centipose, sticky, quick drying, and oxidizing in contact with air. The novel cartridge of this invention has a multiple chamber design which completely isolates from the outside the particular fluid substance that is to be dispensed out of the cartridge. The first chamber contains the particular fluid substance of interest and at least a second chamber exists that contains a suitable solvent for the particular substance contained in the first chamber. A multitude of chambers can exist between the first chamber and the outside, in order to provide additional isolation to the particular fluid substance contained in the first chamber. These additional chambers can be filled-up with the same solvent contained in the second chamber or with different solvents. Between any two chambers there is a normally closed valve. A normally closed valve also exists between the last chamber and the outside. The novel, multi-chamber cartridge solves many of the shortcomings found in other cartridge designs including clogging of the dispensing orifice and allows for the cartridge to be stored for long periods of time without affecting the properties of the substance contained in the cartridge and without needing any cleaning or other maintenance before reuse of the cartridge.

A dispenser can reach the particular fluid substance in the first chamber by inserting a tube that would pass through the normally closed valve separating the outside and the last chamber and through all normally closed valves that separate the chambers until the tube reaches the particular fluid substance in the first chamber. The novel cartridge is particularly well suited, but not limited to, for dispensing cosmetics such as nail polish, hair dyes, eye shadow, lip gloss, lipstick, lotions, moisturizers, creams, sunscreens, and fragrances. Substances typically used in cosmetics have high viscosities, are designed to be sticky, dry out (solvent evaporates) in air and in many cases these solvents evaporate very quickly. Furthermore, some cosmetic substances, such as hair dyes, react with oxygen (oxidize) and need to be kept sealed from contact with air until they are being used. Another suitable application of the novel cartridge is for storing and dispensing medicine that gets mixed, as needed, in pharmacies and needs to be isolated from exposure to air while stored.

Figure 1:
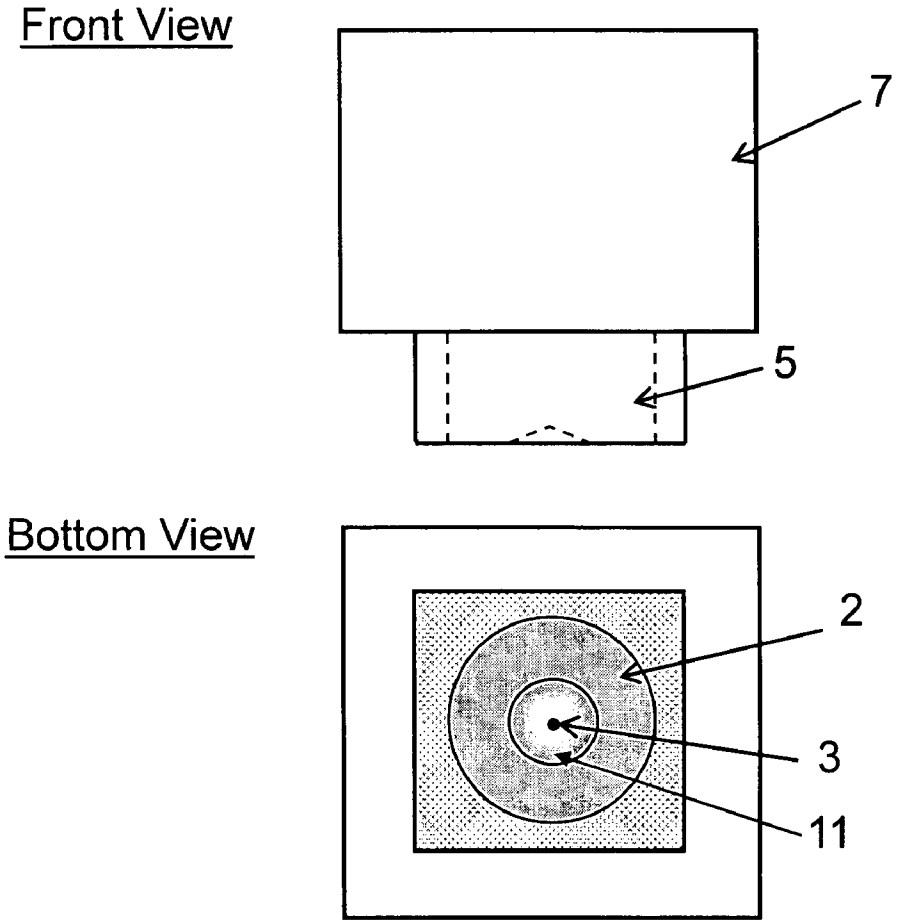
FIG. 1 shows a schematic front and bottom view of an embodiment of the cartridge.

An embodiment of the present invention is shown in the schematic presented in FIG. 1. FIG. 1 shows the front and bottom views of a two chamber embodiment of the present invention. The front view part of FIG. 1 shows the outline of the first chamber 7 and the second chamber 5. Some internal lines of the second chamber 5 are also represented with broken lines. The bottom view of FIG. 1 shows more features of an embodiment of the second chamber 5. A tightly fit insert 2 delimitates the boundaries of the cavity part of the second chamber 5. The insert 2 has a conical shaped area 11 that facilitates the penetration of a tube (which will reach into the first chamber) from a dispenser (not shown). The center of the conical shaped area 11 has a normally closed valve 3.

Figure 2:
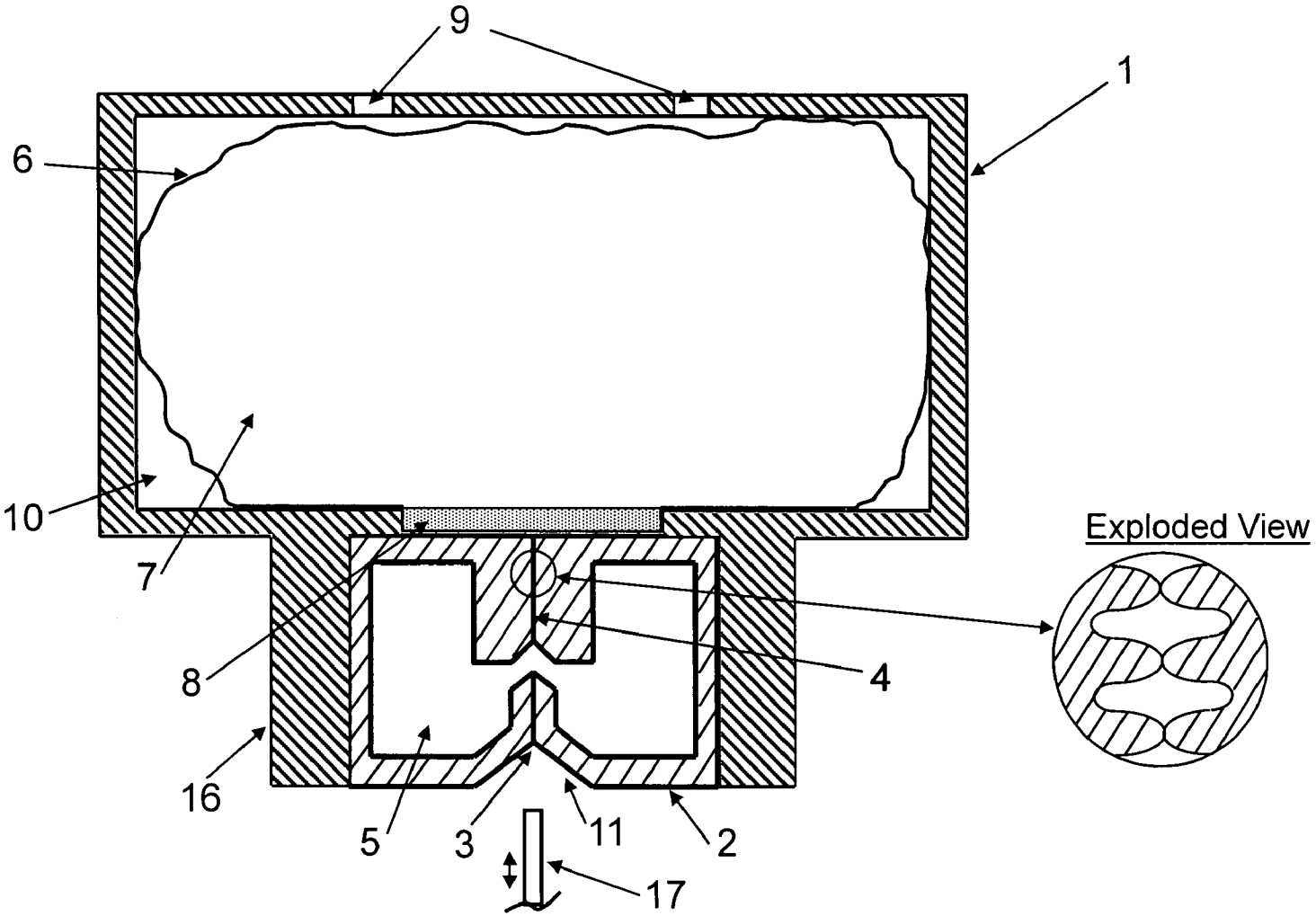
FIG. 2 shows a schematic cross-sectional view of one embodiment of the cartridge.

A schematic cross-sectional view of one embodiment showing a two-chamber cartridge is shown in FIG. 2. The cartridge comprises a protective outside hard shell 1 which has a multitude of holes 9 all-around the first chamber 7, a second chamber 5, an insert 2, and a flexible membrane 6 that can be made out of an elastic (initially stretched out when fully filled) or inelastic material. The hard shell 1 provides, on the outside, positioning guides 16 that allow precise placement and locking into place between the cartridge and the dispensing mechanism. The positioning guides 16 can be a portion of the outer shape of the hard shell 1. The first chamber 7 comprises a flexible membrane 6 which is impermeable to air and to the particular fluid substance it contains, and an initial seal 8 which can be broken during the first use of the cartridge. The flexible membrane 6 completely encompasses the particular fluid substance, and is protected by the hard shell 1. Initially, the particular fluid substance only touches the flexible membrane 6 and the seal 8. When a dispenser (dispensing mechanism/machine—not shown) removes part of the particular substance, the membrane 6 shrinks around the remaining volume of particular substance in the cartridge. The space 10 that can be located in different places all-around the flexible membrane 6 is exposed to the outside air (atmospheric pressure) through a multitude of holes 9. The second chamber 5 comprises of a hard outside shell that can be part of the shell 1 and an insert 2 which is tightly fit and fixed in the cavity provided. The outside hard shell of chamber 5 can be monolithic with the outside hard shell 1. The insert 2 is in tight contact with (pressed against) the seal 8. The inside of the insert 2 delimitates the boundaries of the cavity of the second chamber 5 which contains the suitable solvent for the particular substance contained inside the flexible membrane 6. The insert 2 includes a normally closed valve 3 between the outside and the second chamber 5, and a second normally closed valve 4 between the first chamber 7 and the second chamber 5. In this particular embodiment the normally closed valves 3 and 4 are represented by orifices made into elastic (rubber like) material such as soft silicone or other polymers. Alternatively, the insert 2 can be replaced by normally closed valve inserts that take the functionality of valve 3 and 4 mentioned above. In this embodiment, the body of insert 2 is replaced by the walls of chamber 5. When the cartridge is not in use, the elasticity of the material around the orifices (the valve material in this particular embodiment) keeps the orifices closed. When a dispenser needs to dispense some of the particular substance stored inside the flexible membrane, a tube 17 from a dispensing mechanism would penetrate through valve 3 forcing the orifice to open and then penetrate through valve 4, in the same manner, until it reaches the particular substance inside membrane 6. The exterior (outwards facing) shape 11 of valves 3 and 4 are conical in order to facilitate the penetration of the dispenser tube. The orifices can have smooth, straight walls or can be ribbed and have, along the length of the orifice, multiple points of contact alternating with spaces as shown in the exploded view of a section of valve 4. The ribbed walls in essence create a chain of multiple mini valves in series that could reduce, if needed, the amount of particular fluid substance or solvent that moves into the valve channel when the tube of the dispenser is withdrawn from the cartridge. Following the withdrawal of the tube of the dispenser, all the valves resume the normally closed position providing air and fluid tight seals. The valves 3 and 4 can have other shapes or designs that meet the functionality and the requirements explained above. For example, valves 3 and 4 can also include a piece of material 12 attached on the upper side of the valve insert that will add an extra valve to the multiple mini valves in series created by the ribbed inside walls.

Figure 3:
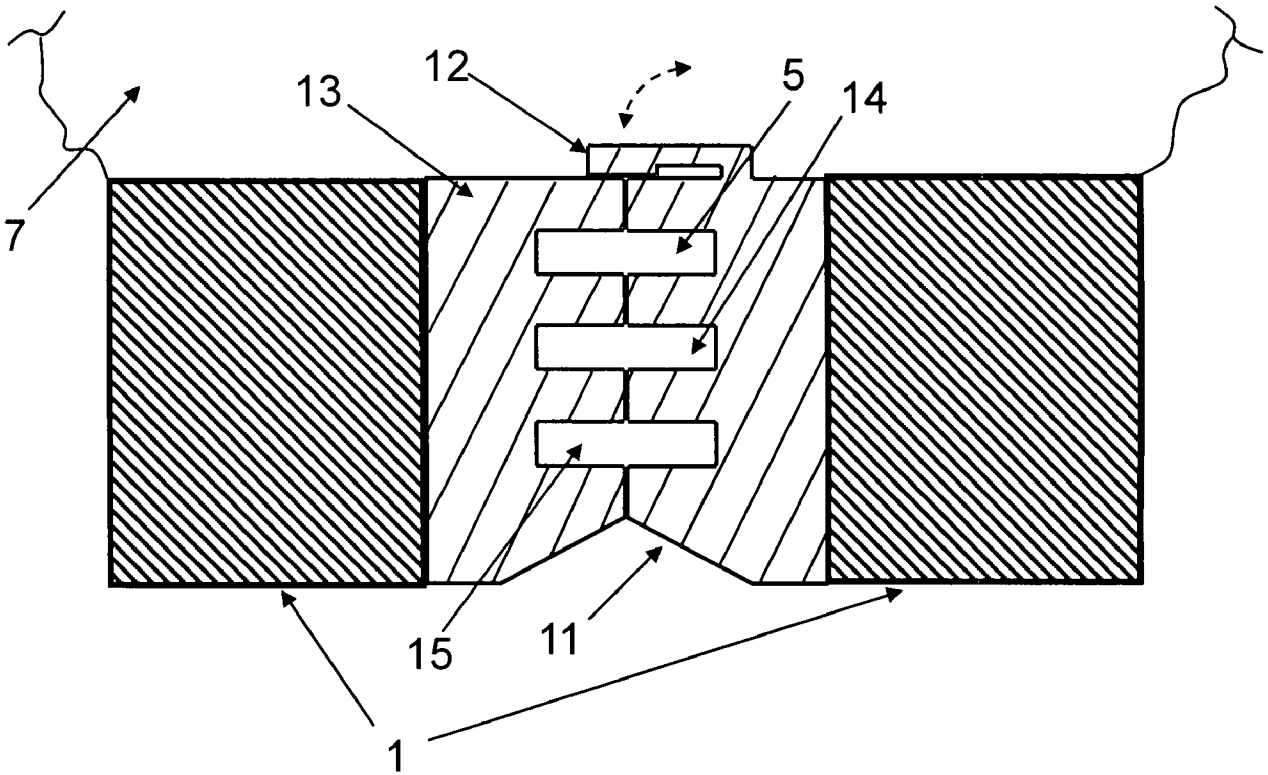
FIG. 3 shows a schematic cross-sectional view of an embodiment of a valve insert in a four serial chamber arrangement, with three solvent filled chambers.

FIG. 3 shows a cross sectional view of a possible embodiment, with four chambers, that has of a valve insert 13 placed directly into the hard shell 1. The first chamber 7 contains the particular fluid to be dispensed, while second chamber 5, third chamber 14, and fourth chamber 15 (which is also the last chamber) contain a suitable solvent for the particular fluid in first chamber 7. In a two chamber configuration, second chamber 5 is the last chamber, while in a four chamber configuration, the fourth chamber 15 is the last chamber. As seen in FIG. 2, all the chambers are arranged in a serial fashion. When a dispensing operation is performed, a tube from a dispenser mechanism (not shown) would pass, starting with the last chamber, through all the chambers and the normally closed valves separating each two adjacent chambers until reaching the particular fluid in first chamber 7. In any number of chambers configuration, the last chamber has a normally closed valve that separates the outside region from the inside of the cartridge.

To minimize or prevent removal of solvent from the second chamber 5, in FIG. 2, the shape of the upper part of the walls of the normally closed valve 3 can be designed to mate with the bottom part of the normally closed valve 4. FIG. 2 shows the upper part of the walls of the normally closed valve 3 to be in a funnel shape that match and can mate with the funnel shape of the bottom part of the normally closed valve 4. When the tube from a dispenser starts penetrating valve 3, the valve would move up and press against the mating bottom part of valve 4. In this way, when the tube from the dispenser moves up into the cartridge and reaches valve 4, the solvent from chamber 2 would be prevented from getting into the tube or in any valve channels.

The embodiments presented above are only two of many possible embodiments and are presented to facilitate the understanding of the invention and not as a limitation on the scope of the invention.

What is claimed is:

1. A cartridge that can hold various fluids and allows dispensing of said fluids, the cartridge comprising:

a body with multiple chambers arranged in series configuration, with the first chamber containing into a flexible membrane, the particular fluid to be dispensed;

at least a second chamber containing a suitable solvent for the fluid contained in the said first chamber;

at least two normally closed valves with one of said valves separating said chambers and at least a second valve between the, said valves allowing a dispensing mechanism to reach the fluid to be dispensed from said first chamber, while sealing around the mechanism during the dispensing operation;

positioning guides that allow precise placement between the cartridge and the dispensing mechanism.

2. The cartridge of claim 1, wherein said flexible membrane is made out of an elastic material that is initially stretched out.

3. The cartridge of claim 1, wherein said body with multiple chambers arranged in series configuration has an initial seal that separates the said particular fluid of interest inside the said flexible membrane, said seal being broken after the first dispense from the cartridge.

4. The cartridge of claim 1, wherein said valves are conically shaped on the side facing the outside towards the dispensing mechanism.

5. The cartridge of claim 1, wherein said normally closed valves have annular, ribbed walls creating a chain of multiple mini valves in series.

6. The cartridge of claim 1, wherein said normally closed valves are conically shaped on the side facing each other and their surfaces mate during dispensing to prevent the solvent from said second chamber from being dispensed along with the said fluid from first chamber.

* * * * *